United States Patent [19]

Aoyagi et al.

[11] Patent Number: 4,898,484

[45] Date of Patent: Feb. 6, 1990

[54] THERMAL TRANSFER PRINTER

[75] Inventors: Yuuji Aoyagi; Syouji Yokoyama; Tomohiko Yanagita, all of Hitachi, Japan

[73] Assignee: Hitachi, Ltd., Tokyo, Japan

[21] Appl. No.: 248,287

[22] Filed: Sep. 22, 1988

Related U.S. Application Data

[63] Continuation of Ser. No. 832,130, Feb. 24, 1986, abandoned.

[30] Foreign Application Priority Data

Feb. 27, 1985 [JP] Japan ..... 60-38161

[51] Int. Cl.[4] ..... B41J 35/22

[52] U.S. Cl. ..... 400/120; 400/208; 400/206.2; 346/105

[58] Field of Search ..... 346/105, 106, 76 PH; 400/120, 208, 206.2, 231, 214, 211

[56] References Cited

U.S. PATENT DOCUMENTS

| | | | |
|---|---|---|---|
| 4,188,135 | 2/1980 | Mizutani et al. | 400/214 |
| 4,289,412 | 9/1981 | Dollenmayer | 400/171 |
| 4,443,121 | 4/1984 | Arai | 400/120 |
| 4,569,608 | 2/1986 | Watanabe | 400/208 |
| 4,614,949 | 9/1986 | Hakkaku et al. | 346/105 |
| 4,632,585 | 12/1986 | Oyamatsu et al. | 400/120 |

FOREIGN PATENT DOCUMENTS

| | | | |
|---|---|---|---|
| 184234 | 6/1986 | European Pat. Off. | 400/206.2 |
| 2543376 | 3/1977 | Fed. Rep. of Germany | 400/214 |
| 62184 | 5/1981 | Japan | 400/231 |
| 201880 | 11/1984 | Japan | 400/231 |
| 192681 | 10/1985 | Japan | 400/214 |

OTHER PUBLICATIONS

Meier, "Multicolor Matrix Impact Printer", IBM Technical Disclosure Bulletin vol. 21, No. 11, pp. 4448–4451, 4–79.

Meier et al, "Multiple Ribbon . . . Printer", IBM Technical Disclosure Bulletin vol. 22, No. 10, pp. 4481–4482, 3–80.

Humphreys, "Individual Motion . . . Ribbons" IBM Technical Disclosure Bulletin vol. 27, No. 8, p. 5018, 1–85.

*Primary Examiner*—William Pieprz

*Attorney, Agent, or Firm*—Antonelli, Terry & Wands

[57] ABSTRACT

A thermal printer including a thermal printer and a thermal head wherein a clearance between the platen and the thermal head is not less than a maximum diameter of one roll of an ink filled ribbon set by a thermal head driving motor. A ribbon cassette is moved to a printing position and, after a printing operation has been completed to another ribbon cassette. A guiding arrangement for positioning the ribbon cassettes in predetermined positions is adapted to be rotatably driven by a ribbon cassette motor and a plate for supplying the ribbon cassette and receiving the ribbon cassetts. The plate is joined to a take-up end portion of the ribbon cassette and the guiding arrangement is adapted to be moved in the forward and rearward direction for supplying the ribbon cassette and receiving the ribbon cassette by a transfer belt which can be moved by a cassette-moving motor. The guiding arrangement is adapted to be changed by withdrawing from the ink ribbon to another ink ribbon by a fixing member which is adapted to be moved by a ribbon cassette motor. A plurality of ribbon cassettes can be selectively used so that an unnecessary feeding of the ink ribbon can be avoided.

15 Claims, 8 Drawing Sheets

THERMAL TRANSFER PRINTER

This application is a Continuation of application Ser. No. 832,130, filed Feb. 24, 1986, now abandoned.

BACKGROUND OF THE INVENTION:

The present invention relates to a thermal transfer printer, and, more particularly, to a line type thermal transfer printer having an ink film ribbon interchanging mechanism which provides a plurality of interchangeable ink film ribbons and is capable of carrying out, for example, a color printing operation.

In a conventional line type thermal transfer printer such as disclosed in, for example, the Japanese Patent laid-open publication No. 204575/1984, a thermal head is pressed against a platen through a recording paper and an ink film ribbon.

The thermal head is withdrawn to the withdrawal position, while the recording paper and the ink film ribbon are moved relative to each other, to thereby release the thermal head from the pressure for urging the thermal head against the platen. The withdrawal distance of the thermal head during this time is slightly greater than a total thickness of the recording paper and the ink film ribbon in the laminated state.

This type of line type thermal transfer printers are generally provided with only one roll of the ink film ribbon and, in such thermal transfer printers, the necessity of the interchanging a plurality of the ink film ribbons during the printing operation is not taken into consideration.

An object of the present invention resides in providing a thermal transfer printer wherein a plurality of ink film ribbons can be used selectively in accordance with a desired color in which an object image is to be printed.

Another object of the present invention resides in providing a thermal transfer printer wherein an useless feeding of an ink film ribbon can be prevented regardless of the letter pattern in use.

Yet another object of the present invention resides in providing a thermal transfer printer wherein the operating cost of the thermal transfer printer can be reduced.

A further object of the present invention resides in providing a thermal transfer printer wherein a plurality of ink film ribbons can be interchangeable.

Another object of the present invention resides in providing a thermal transfer printer wherein the types of ink film ribbons can be identified.

A still further object of the present invention resides in providing a thermal transfer printer wherein a color printing operation can be carried out.

A further object of the present invention resides in providing a thermal transfer printer wherein an image can be printed in gradually-varying colors when ink film ribbons of different density are provided within ink ribbon cassettes.

Yet another object of the present invention resides in providing a thermal transfer printer wherein a monochromatic printing ink film ribbon and a color printing ink film ribbon can be installed.

Yet another object of the present invention resides in providing a thermal transfer printer wherein a draft copy function can be furnished when an ink film ribbon of an inferior printing quality is set in the thermal transfer printer with a regular ink film ribbon of a high printing quality.

A still further object of the present invention resides in providing a thermal transfer printer wherein a beautiful and truly black printing can be obtained without a mixture of inks of three primary colors.

In accordance with the present invention a thermal transfer printer is provided which includes a case, side plates provided at both sides of the case, a platen provided between the side plates, rollers provided between the side plates and being in press-contact with the platen and an ink film ribbon wounded around a send-out roll being taken up around a take-up roll through the platen. A recording paper is disposed opposite to an ink layer on the ink film ribbon being sent to a printing position by the platen. A thermal head is provided having heating elements disposed in a main scanning direction, with the heating elements of the thermal head being pressed against the platen through the ink film ribbon and the recording paper. A feeding means for the recording paper is provided in the case communicating to the platen through a connecting means, with a feeding means for the ink film ribbon being provided in the case. A supporting means for the thermal head is provided in the case and is movable between the side plates. A driving means for the thermal head supporting means provided in the case so as to transmit a force, with the thermal head being adapted to be brought against the ink film ribbon being heated in accordance with a recording information and an ink image is transferred to and recorded on a surface of the recording paper. A driving means is provided which is capable of setting a clearance between the platen and the thermal head to a width which is not less than a maximum diameter of one roll of the ink film ribbon and means are provided for guiding the ink film ribbon to a predetermined recording position so as to position the ink film ribbon.

The ink ribbon cassette, which contains a first ink film ribbon is moved as required in accordance with a recording information to the printing position in which the thermal head is disposed. The first ink ribbon cassette is changed after a printing with the first ink film ribbon has been completed to a second ink ribbon cassette which contains a second ink film ribbon.

The guiding means for a plurality of the ink ribbon cassettes in the predetermined positions therein is adapted to be rotated for sending out the first ink ribbon cassette to be used and receiving the second ink ribbon cassette by an ink ribbon cassette-driving motor.

The guiding means for a plurality of the ink ribbon cassettes in the predetermined positions therein is adapted to be moved forward and backward for sending out the first ink ribbon cassette to be used and receiving the second ink ribbon cassette by an ink ribbon cassette transfer means which can be moved to a position by driving an ink ribbon cassette-moving motor.

The guiding means for a plurality of the ink ribbon cassettes in the predetermined positions therein is adapted to be changed by withdrawing from the first ink film ribbon in the first ink ribbon cassette to the second ink film ribbon in the second ink ribbon cassette by an ink ribbon cassette fixing member which can be moved by an ink ribbon cassette lifting and lowering motor.

According to the present invention, a plurality of ink film ribbons or ink ribbon cassettes can be used selectively in accordance with a desired color in which an object image is to be printed, so that the useless feeding of an ink film ribbon can be prevented regardless of the letter pattern in use.

Since the ink film ribbon is not uselessly fed, the operating cost can be reduced to a low level. A black image can be printed in black ink which is not a mixture of ink of three primary colors. Therefore, a color thermal transfer printer, which enables beautiful, truly black printing to be done, can be obtained.

DETAILED DESCRIPTION OF THE PREFERRED EMBODIMENT

Figure 1:
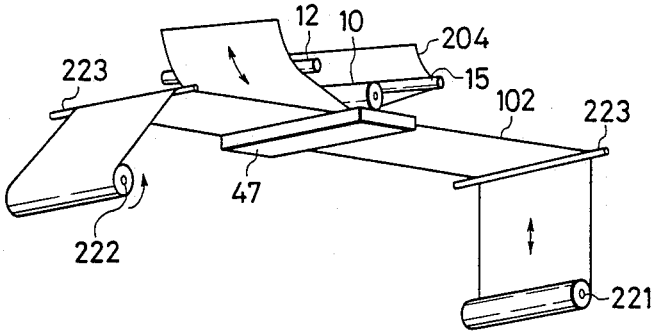
FIG. 1 is a schematic view depicting the principle of a line type thermal printer.

Referring now to the drawings wherein like reference numerals are used throughout the various views to designate like parts and, more particularly, to FIG. 1, according to this figure, an ink film ribbon 102, wound around, a supply roll 221 is received around a take-up roll 222 through an ink ribbon guide **223*a*, a round platen 10, and an ink ribbon guide 223*b***. A flat platen may also be used as a platen.

A recording paper 204 is supplied to a printing position by the platen 10. A thermal head 47 has a row of longitudinally arrayed or main-scanningly arrayed heating elements thereon, with the heating elements of the thermal head 47 being pressed against the platen 10 through the ink film ribbon 102 and the recording paper 204 to generate heat in accordance with the recording information. The heating elements of the thermal head 47 transfer and record an image on the recording paper 204 disposed opposite to an ink layer on the ink film ribbon 102.

In order to supply the recording paper 204 or the ink film ribbon 102 during the interruption of the printing operation, it is released from the pressing force of the thermal head 47 for the purpose of preventing the occurrence of abrasion marks or rubbing marks on the recording paper 204, which are caused by the pressing force of the thermal head 47.

Figure 2:
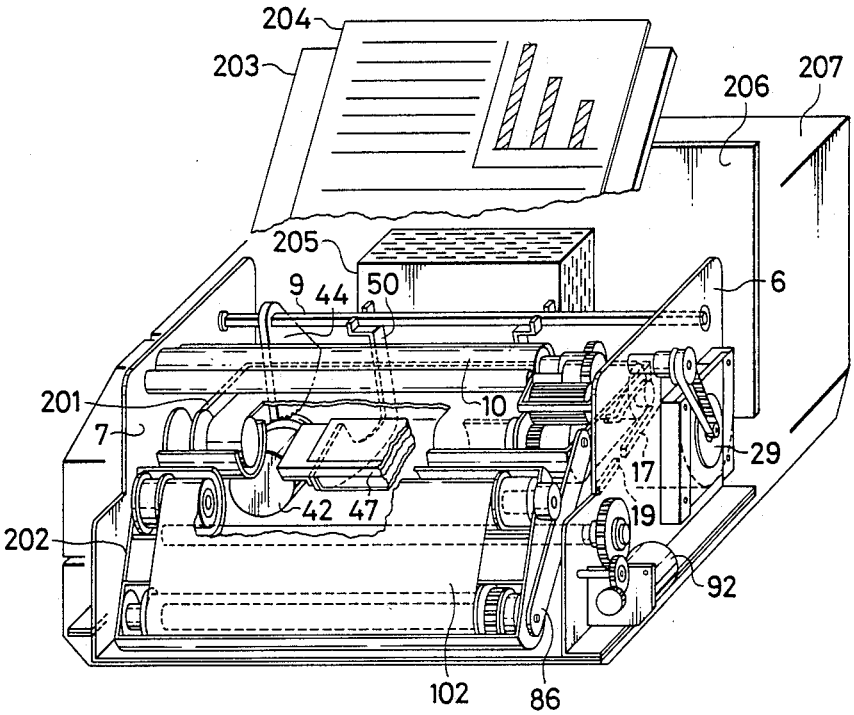
FIG. 2 is a perspective view of a line type thermal transfer printer constructed in accordance with the present invention.

The line type thermal transfer printer shown in FIG. 2 is illustrated in a position for carrying out a printing operation.

Figure 3:
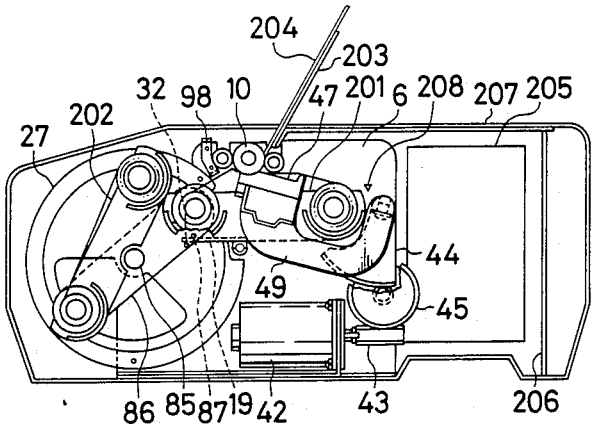
FIG. 3 is a detail view, on an enlarged scale, illustrating a relationship between an ink ribbon cassette, platen and thermal head during a starting of a printing operation.
Figure 4:
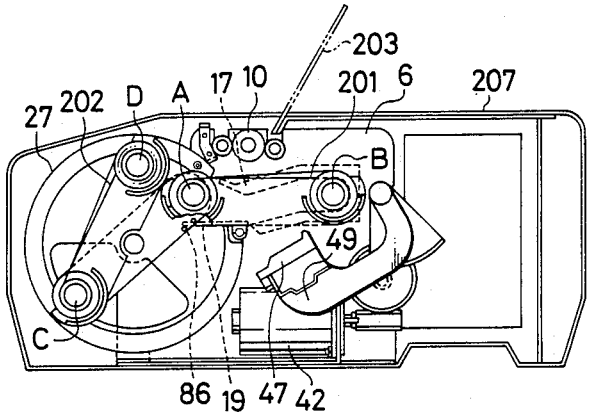
FIG. 4 is a detail view, on an enlarged scale, of a positioning of the thermal head in a cassette interchanging position.
Figure 5:
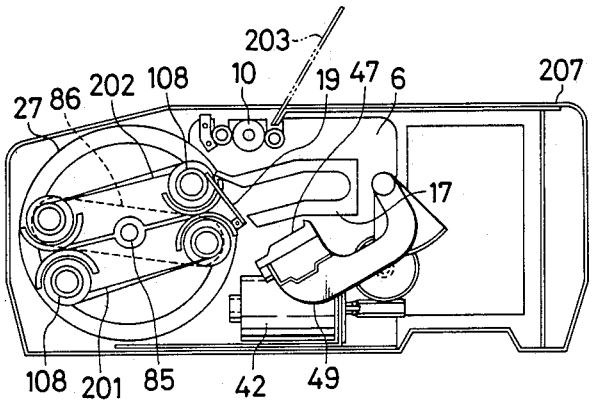
FIG. 5 is a detail view, on an enlarged scale of a further relationship between the ink ribbon cassette, platen, and thermal head.
Figure 6:
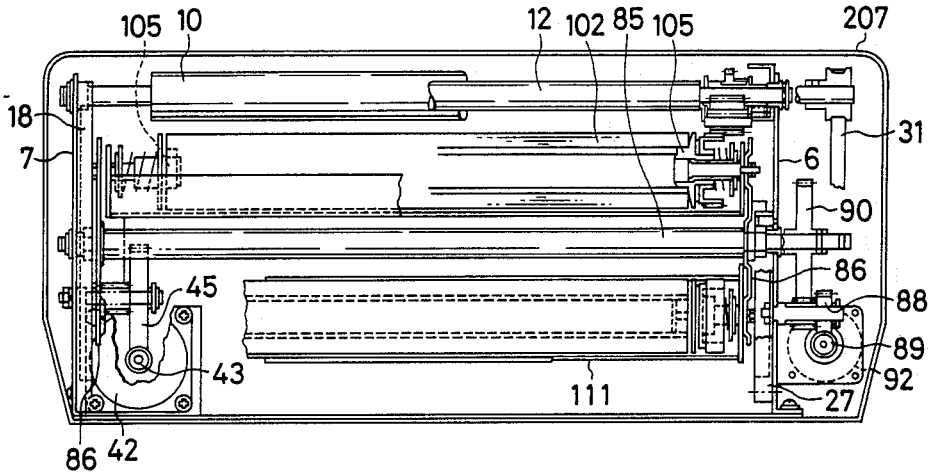
FIG. 6 is a partially schematic view of a thermal printer constructed in accordance with the present invention.
Figure 7:
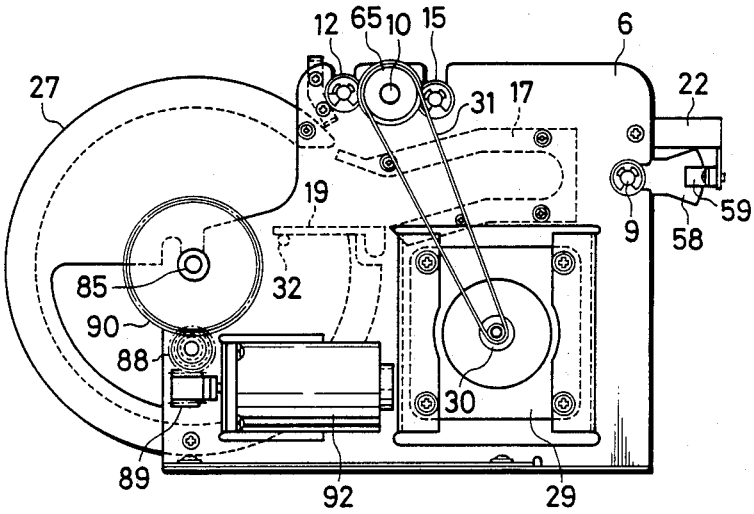
FIG. 7, is a detail view of a thermal transfer mechanism for a thermal printer constructed in accordance with the present invention.

As shown in FIGS. 2, 3 and 5, a case 207 of the thermal transfer printer contains a thermal transfer mechanism shown in FIG. 7, a control base plate 206, and a switching power source 205 for supplying the electric power to the control base plate 206, the thermal head 47 and additional electric components.

A recording paper 204 moves forward on the platen 10 to be printed by the thermal head 47 and an ink film ribbon 102 in the same manner as shown in FIGS. 2 and 3, as in a conventional thermal transfer printer.

In this embodiment, the take-up end portions of ink ribbon cassettes 201 and 202, in which different types of the ink film ribbons 102 are stored, are joined to a cassette plate 86. The cassette plate 86 is turned suitably in accordance with a printing instruction to alternately move the ink ribbon cassettes 201 and 202 onto the platen 10 and print the recording paper 204.

As shown in FIG. 3, the recording paper 204, inserted along a paper guide 203 is carried or supplied to the printing position by the platen 10, a roller 15 and a roller 12 (FIG. 1). The thermal head 47 is fixed to the upper portion of a head arm 49 and is positioned along an arcuate path around a head arm shaft 9.

During the printing operation, the ink film ribbon 102 in the ink ribbon cassette 201 or 202 is pressed against the recording paper 204 on the platen 10 by the thermal head 47. While the recording paper 204 and the ink film ribbon 102 are moved relative to each other, the recording paper 204 and the ink film ribbon 102 are spaced slightly from and released from the pressure of the platen 10 by the thermal head 47.

The different types of the ink film ribbons 102 are respectively stored in the different ink ribbon cassettes 201 and 202. The take-up end portions of these two ink ribbon cassettes 201 and 202 are joined to both end portions of the cassette plate 86. When the cassette plate 86 is turned in accordance with the cassette interchanging instruction from the control unit 206, the ink ribbon cassettes 201 and 202 are alternately moved onto the platen 10. And then the ink ribbon take-up driving force is transmitted thereto from the platen 10 through a joint gear 77.

Figure 12:
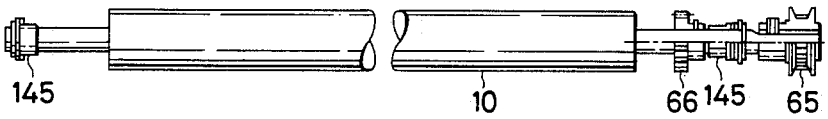
FIG. 12 is a partially schematic view of a platen roller for a thermal printer according to the present invention.

Bush means 145 are provided at both shaft sides of the platen 10 with the bush means 145 being fitted into the side plates 6 and 7 as shown most clearly in FIGS. 2 and 12. A platen gear 66 and a pulley 65 are fixedly mounted on one end portion of the shaft of the platen 10.

A paper feeding motor 29 is provided on the side plate 6, and a timing belt 31 is wrapped around a pulley 30 and the pulley 65 as shown in FIG. 2. The pulley 30 is fixed to the rotary shaft of the paper feeding motor 29. The pulley 65 is fixed to the shaft of the platen 10.

Figure 11:
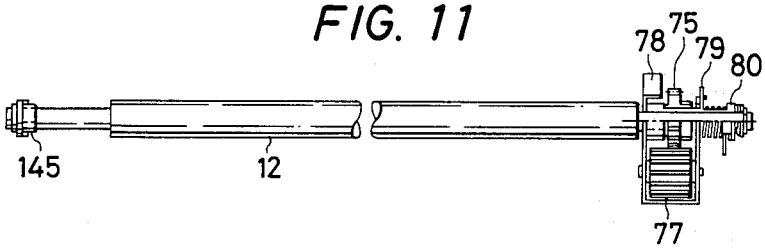
FIG. 11 is a partially schematic view of a roller adapted to contact a platen in a thermal printer of the present invention.
Figure 13:
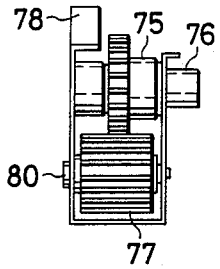
FIG. 13, is a detail view, on an enlarged scale, of a gear arrangement for a contact roller of a thermal printer according to the present invention.
Figure 14:
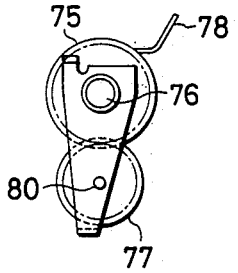
FIG. 14 is a side view of a gear arrangement of FIG. 13.

The roller 12 is in a pressure contact with the platen 10 and the roller 12 forming a paper feed system as shown in FIGS. 11, 13 and 14. Bush means 145 are provided at both shaft sides of the roller 12 with a joint gear shaft 80 means provided at one end of the shaft of the roller 12. The bush means 145 and the joint gear shaft 80 are fitted in the side plates 6 and 7, respectively. The shaft of the roller 12 is further provided on one end portion thereof with a roller gear 75 for transmitting the rotation of the platen 10 to the joint gear 77, the joint gear plate 78, and a joint gear spring 79.

The joint gear 77 is adapted to transmit the rotation of the roller gear 75 to the ink ribbon cassette 201. The joint gear plate 78 supports the joint gear 77 and a joint gear spring 79 biases the joint gear plate 78 to return to an initial position when the thermal head 47 is removed from the platen 10, to interrupt the transmission of the ink ribbon take-up force.

The roller 15, which is driven by the platen 10 with the roller 12, is provided at both end portions of its shaft in the same manner as the roller 12 with bush means 145. The bush means 145 are fitted into the side plates 6 and 7, and the roller 15 is rotated in accordance with the rotation of the platen 10 to which the roller 15 is in a pressing contact.

Figure 8:
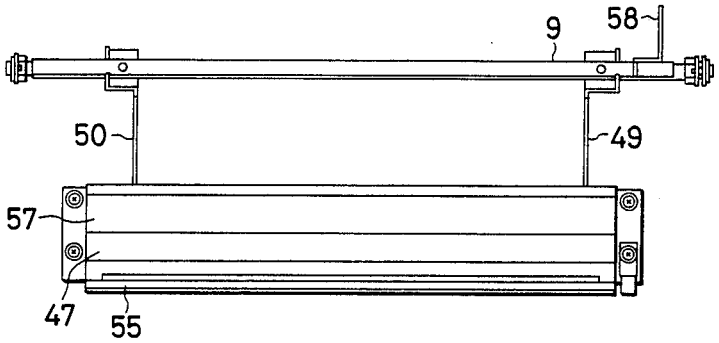
FIG. 8 is a partially schematic view illustrating the relationship between the thermal head, film tension member, head arms, and head arm shaft in a thermal printer according to the present invention.
Figure 9:
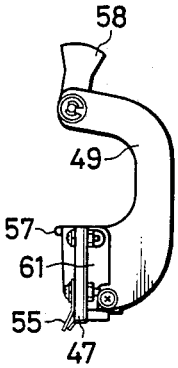
FIG. 9 is a plan view of a head arm of a thermal printer constructed in accordance with the present invention.
Figure 10:
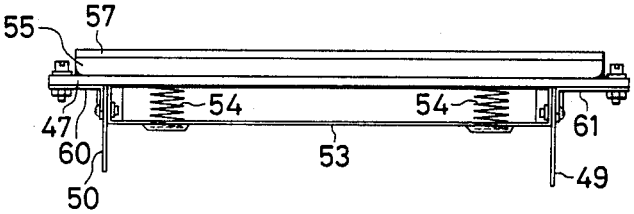
FIG. 10 is a schematic view of a paper guide arrangement for a thermal printer of the present invention.

As shown in FIGS. 8, 9 and 10, the thermal head 47 is provided with an ink film tension member 57 for guiding the ink film ribbon 102 to the thermal head 47 without wrinkling the ink film ribbon 102, and a paper guide 55 for sending the recording paper 204 smoothly between the platen 10 and the roller 12. Head support members 60 and 61 are fixed to the thermal head 47 and engaged through springs 54 with a spring receiving plate 53 fixed to the head arms 49 and 50.

By virtue of the above-described construction, a constant and a uniform pressing force can be obtained when the thermal head 47 is pressed against the platen 10. The head arms 49 and 50 are fixed to the head arm shaft 9 so that the head arms 49 and 50 can be pivoted between the side plates 6 and 7 as shown in FIG. 2. A sensor indicator 58 for detecting the a turned position of the thermal head 47 is fixed to the head arm shaft 9.

Referring to FIGS. 3 to 7, a thermal head-driving motor 42 is provided at the side plate 7. The pivotal force is transmitted from the thermal head-driving motor 42 to the head arm shaft 9 through a head worm gear 43 mounted on the rotary shaft of the thermal head-driving motor 42, a head gear 45 and a head arm gear 44. The head arm gear 44 is fixed to the head arm shaft 9.

To detect the turned position of the thermal head 47, a head sensor mounting member 22 is attached to the side plate 6, and further a thermal head sensor 59 is attached to the head sensor mounting member 22. While the head arm shaft 9 is turned, the sensor indicator 58 moves through the thermal head sensor 59 to detect the position of the thermal head 47.

Figure 15:
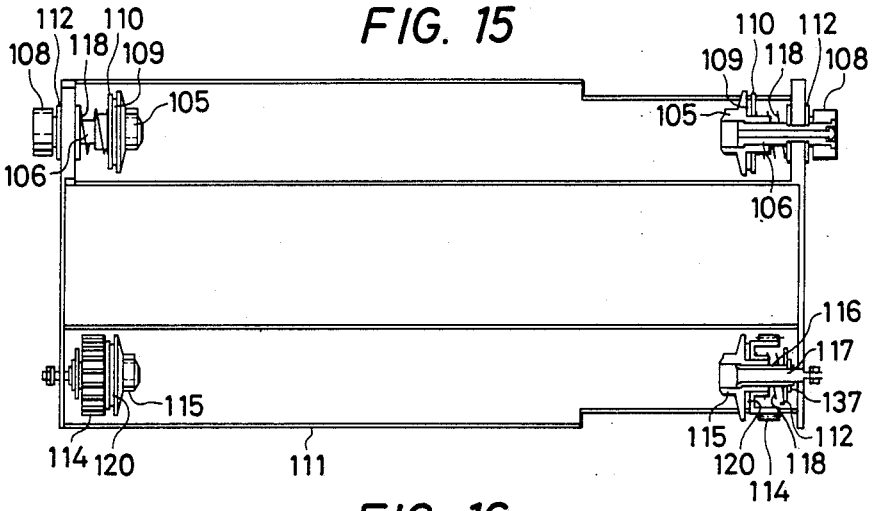
FIG. 15 is a partially schematic view of a cassette body of an ink ribbon cassette for a thermal printer according to the present invention.

FIG. 15 shows a cassette body of the ink ribbon cassette 201 or 202, with a cassette case 111 being provided therein with take-up film holders 115 and supply film holders 105. The take-up film holders 115, mounted on roller shafts 116, are engaged with a core member of the ink film ribbon 102. The take-up film holders 115 are connected to each other by a spring stopper 112, holder shaft pins 117 and a holder spring 118 through cassette gears 114 and friction plates 120. The take-up force is transmitted to the cassette gears 114.

The supply film holders 105, mounted on a roller shaft 106 are fixed to the cassette case 111 by friction plates 109 and the holder springs 118 so that the sendout film holders 105 having spring stoppers 110 can slip slightly. Freely rotatable cassette rollers 108 are mounted on the portions of the shafts of the supply film holders 105. The cassette rollers 108 are on the outer side of the cassette case 111.

Figure 16:
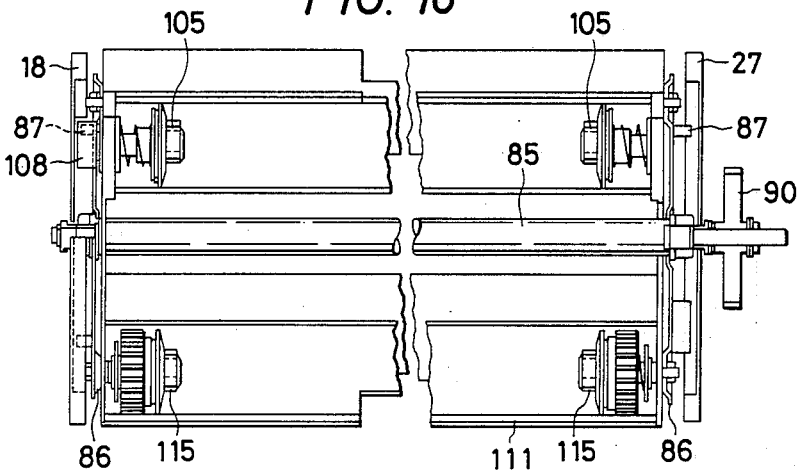
FIG. 16, is a partially schematic view of an ink ribbon cassette disposed in a thermal printer body of a thermal printer constructed in accordance with the present invention.

This ink ribbon cassette set in the thermal transfer printer body is shown as in FIG. 16. The shafts of the take-up holders 115 in the cassette case 111 are connected to the cassette plates 86 on the outer side of the cassette case 111. Each of the cassette plates 86 is fixedly mounted at a central portion thereof on a drum shaft 85 and turned in accordance with the rotation of a cassette drum gear 90.

The cassette drum gear 90 receives the rotational force of an ink ribbon cassette-driving motor 92 mounted on the side plate 6, through a cassette gear 88 and a cassette worm gear 89. As shown FIG. 6 the cassette case 111 is provided at both sides thereof with the roller guides 18 and 27 for smoothly carrying out the rotation of the ink ribbon cassette 201 or 202 around the drum shaft 85, cassette relief members 19 for guiding the ink ribbon cassette 201 or 202 onto the platen 10, and cassette guides 17.

The cassette rollers 108, provided on the outer side of the cassette case 111, run along the guiding surface of the roller guides 18 or 27, the cassette relief members 19, and the cassette guides 17, respectively.

The ink ribbon take-up force from the platen 10 is transmitted to the cassette gears 114 in the ink ribbon cassette 201 or 202 guided onto the platen 10 by the joint gears 77 mounted on the shaft of the roller 12.

FIG. 3 shows the ink ribbon cassette 201 set on the platen 10, and the thermal head 47 pressing the ink film ribbon 102 and the recording paper 204 against the platen 10. The thermal head 47 then generates heat, and the printing operation, i.e. the operation of the thermal transfer printer is started.

In order to change the ink ribbon cassette 201 to the ink ribbon cassette 202 after the printing operation using the ink ribbon cassette 201 has been completed, it is necessary for the thermal head 47 to be separated from the platen 10 by a distance of not less than a thickness of the ink ribbon cassette 201.

In order to separate the thermal head 47 from the platen 10, the thermal head-driving motor 42 is rotated to drive the head worm gear 43, the head gear 45 and the head arm gear 44 connected to the thermal head-driving motor 42. The thermal head 47 is moved to the ink ribbon cassette-interchangeable position shown in FIG. 4.

In order to change the ink ribbon cassette 201, the ink ribbon cassette driving motor 92 is energized to turn the cassette plate 86 about the drum shaft 85. The ink ribbon cassette changing operation with the pivotal movement of the cassette plate 86 will now be described with reference to FIGS. 17A to 17H.

Figure 17A:
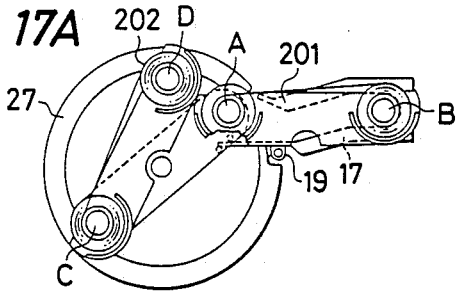
FIGS. 17A–17H are detailed views illustrating various stages of a ribbon cassette changing operation.
Figure 17B:
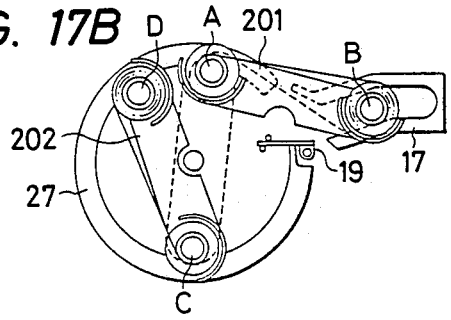
Figure 17C:
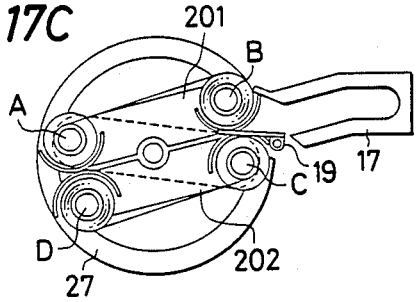
Figure 17D:
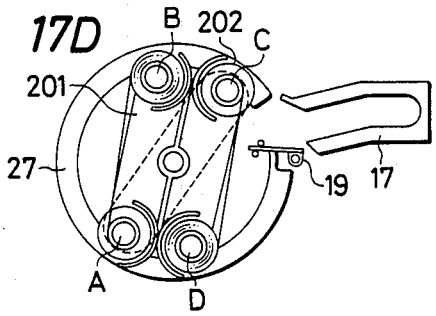

The ink ribbon cassette 201, which is in a position in which the printing operation can be carried out, and which has been guided to the position by the cassette guide 17, is locked in the same position shown in FIG. 17A.

When the cassette plate 86 is now turned in a counter-clockwise direction by 360°, the ink ribbon cassette 202 turns in a counter-clockwise direction along the guiding surface of the roller guide 27. The ink ribbon cassette 201 is withdrawn from the position in which the printing operation can be carried out, along the guiding surfaces of the cassette guide 17 and the cassette relief member 19, and also turns in a counter-clockwise direction along the roller guide 27 as shown in FIGS. 17B to 17F.

Figure 17E:
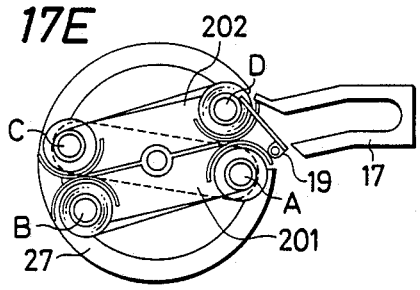
Figure 17F:
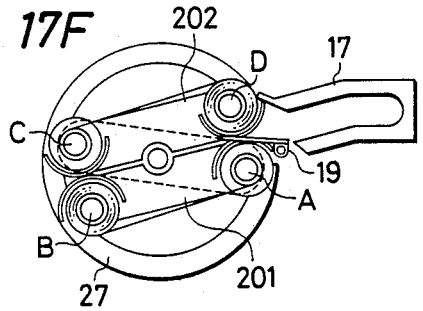

During this time the cassette relief member 19 is raised as shown in FIGS. 5 and 17E by the cassette roller 108 so that the cassette relief member 19 does not obstruct the pivotal movement of the ink ribbon cassette 202 after the ink ribbon cassette 201 has been drawn into the inside of the roller guide 27. The cassette relief member 19 falls again after the cassette roller 108 has passed the cassette relief member 17 as shown in FIG. 17F.

Figure 17G:
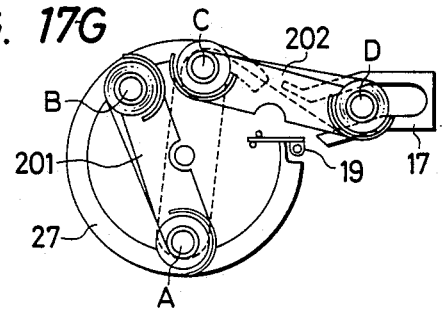

When the cassette plate 86 is turned in a clockwise direction to 180° after the ink ribbon cassettes 201 and 202 have been turned in a counter-clockwise direction by 360°, the ink ribbon cassette 201 turns in a clockwise direction along the guiding surface of the roller guide 27 due to the cassette relief member 19, which is stopped in a horizontally-extending position by a cassette support pin 32 as shown in FIG. 17G.

Figure 17H:
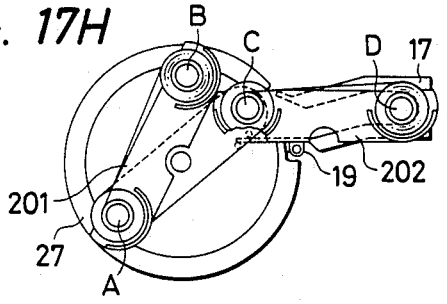

As shown in FIG. 17H, the ink ribbon cassette 202 is guided to a position for enabling the printing operation to be carried out on the platen 10 along the guiding surfaces of the cassette relief member 19 and the cassette guide 17.

Upon the arrival of ink ribbon cassette 202 at the above noted position, in which the printing operation can be carried out, the position is detected by a cassette type identification sensor 208 to stop the pivotal movement of the cassette plate 86. The thermal head-driving motor 42 then beings to raise the head arm 49 to set the thermal head 47 into the printing condition.

In this embodiment, two ink ribbon cassettes 201 and 202 can be selectively used. In this line type thermal transfer printer, a monochromatic printing ink ribbon cassette, having a high frequency of use and a color printing ink ribbon cassette having a low frequency of use, are separately used.

Accordingly, when only the monochromatic printing ink ribbon cassette is used, the printing operation can be carried out at the low operating cost without unnecessary feeding of the color ink film ribbon, and the printing can be effected by using a non-mixed black color ink film ribbon.

If ink film ribbons of different density are provided in the ink ribbon cassettes, simple gradation printing can also be done. If an ink film ribbon of an inferior printing quality, which can be used several times, is set in the thermal transfer printer with a regular ink film ribbon of a high printing quality, which can be used only once, it is possible to furnish the thermal transfer printer with a draft copy function.

Figure 18:
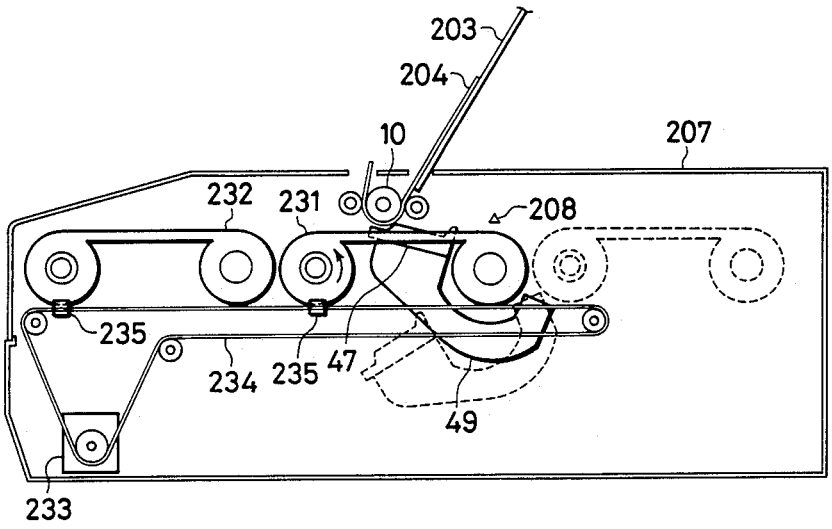
FIG. 18 is a further embodiment of a thermal printer constructed in accordance with the present invention.

The embodiment of FIG. 18 differs from the embodiment of FIG. 2 in that the interchanging of the ink ribbon cassettes is accomplish by moving the ink ribbon cassettes to the front and rear portions of the interior of the thermal transfer printer in the embodiment of FIG. 2.

The ink ribbon cassettes 231 and 232 are longitudinally arranged and engaged at a part of each thereof with a cassette transfer belt 234 through a cassette locking member 235. The cassette transfer belt 234 can be moved to predetermined position by driving an ink ribbon cassette-moving motor 233. In the embodiment of FIG. 18, two ink ribbon cassettes 231 and 232 can be selectively used.

In order to change an in use rear ink ribbon cassette 231, with a front ink ribbon cassette 232, the head arm 49 is lowered to retract the thermal head 47, and the ink ribbon cassette-moving motor 233 is rotated to the right to move the two ink ribbon cassettes 231 and 232.

The arrival of the ink ribbon cassette 231 or 232 at a predetermined position, in which the printing operation can be carried out, is detected by a cassette type identification sensor 208 to stop the movement of the cassette transfer belt 234. The head arm 49 is then raised to set the thermal head 47 in the printing starting condition. The ink ribbon take-up force is supplied from the joint gear.

Figure 19:
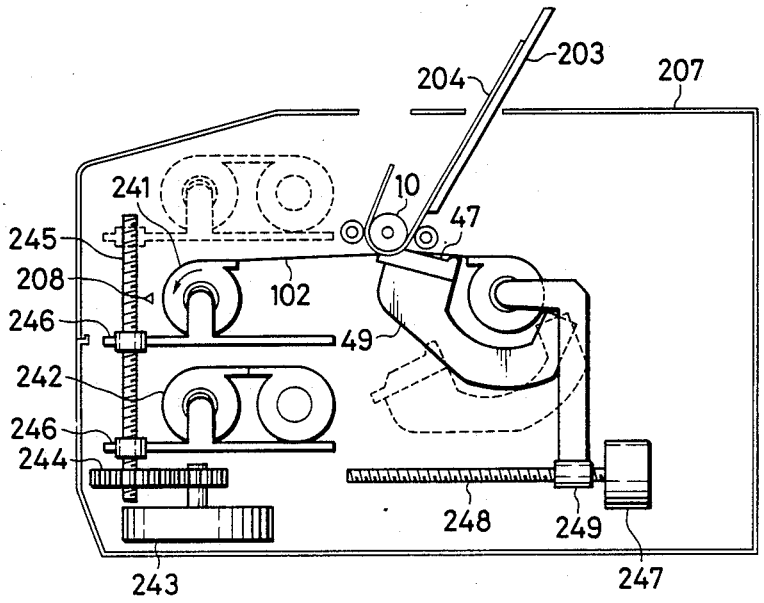
FIG. 19 is a detail view of yet another embodiment of a thermal printer constructed in accordance with the present invention.

The embodiment of FIG. 19 differs from the embodiments of FIGS. 2 and 18 in that the ink ribbon cassettes are piled in a plurality of steps, which the ink ribbon cassettes are moved vertically to withdraw the ink film ribbon from one of the ink ribbon cassettes as necessary to the position of the thermal head.

In the embodiment of FIG. 19, each of the ink ribbon cassettes 241 and 242 can be divided into a take-up portion and a supply portion, respectively. When an ink ribbon cassette 241 is fitted around an ink ribbon cassette fixing member 246, a divided-cassette locking member is disengaged.

Consequently, the take-up portion of the ink ribbon cassette 241 is joined to a joint gear, which is engaged with an ink ribbon take-up motor, and the send-out part of the ink ribbon cassette 241 tentatively engages with the upper portion of the ink ribbon cassette fixing member 246.

The ink ribbon cassette fixing member 246 can be moved to the arbitrary position in the vertical direction in accordance with the rotation of an ink ribbon cassette lifting and lowering gear system 244 and a cassette lifting and lowering worm wheel 245 which are driven by an ink ribbon cassette lifting and lowering motor 243. The detection of the arrival of the ink ribbon cassette 241 or 242 at the printing position is accomplished by utilizing the cassette type identification sensor 208.

In the embodiment of FIG. 19, two ink ribbon cassettes 241 and 242 can be selectively used, and the upper ink ribbon cassette 241 is now selected. In the structure for withdrawing the ink ribbon cassette 241 at its supply portion, an ink ribbon withdrawing motor 247 is driven to turn an ink ribbon withdrawing worm wheel 248.

Consequently, an ink ribbon withdrawing arm 249 is moved in the longitudinal direction to hold the supply portion of the ink ribbon cassette 241 from both sides thereof and withdraw the ink ribbon cassette 241. All of these operations are carried out as required in accordance with an electrical output signal from a control unit in the thermal transfer printer.

In order to change the upper ink ribbon cassette 241, which is selected and used in the embodiment of FIG. 19, with the lower ink ribbon cassette 242, the head arm 49 is lowered to remove the thermal head 47, and the ink ribbon withdrawing motor 247 is driven to move the ink ribbon withdrawing arm 249 in the forward direction. During this time, an ink ribbon take-up motor is rotated so that the ink film ribbon 102 is taken up at a speed which is equal to the moving speed of the ink ribbon withdrawing arm 249.

When the supply portion of the ink ribbon cassette 241 arrives at a predetermined position on the ink ribbon cassette fixing member 246, the ink ribbon cassette locking portion of the ink ribbon withdrawing arm 249 is disengaged to tentatively lock from the ink ribbon cassette 241 on the ink ribbon cassette fixing member 246. The ink ribbon cassette lifting and lowering motor 243 is then driven to move the ink ribbon cassette fixing member 246 to the upward direction.

The arrival of the lower ink ribbon cassette 242 at the position, in which the printing operation can be carried out, is detected by the ink ribbon cassette type identification sensor 208, and the supply portion of the ink ribbon cassette 242 is held at its both sides by the ink ribbon withdrawing arm 249 to withdraw the ink ribbon cassette 242. The head arm 49 is then raised to set the thermal head 47 in the printing starting condition.

The ink ribbon take-up force is supplied from the joint gear in the same way as in the above-described embodiments. While worm gears have been described as being used as the ink ribbon cassette lifting and lowering means and the ink ribbon withdrawing means as apparent, other means, such as for example, links, may also be used to carry out these operations.

In the thermal transfer printer of the embodiment of FIG. 2, when more than two ink film ribbons are installed in more than two ink ribbon cassettes, for example, four ink film ribbons are installed in the four ink ribbon cassettes, each of the ink ribbon cassettes may be divided into a take-up portion and a supply portion, respectively.

We claim:

1. A thermal transfer printer comprising:

a case; side plates respectively provided at opposite sides of said case; a platen mounted between said side plates; a roller mounted between said side plates in pressure contact with said platen; a plurality of interchangeable rolls of ink film ribbon, each with an ink layer wound around a supply roll and arranged to be taken up around a take-up roll in an ink film take-up direction by a force transmitted from said platen; recording paper disposed in opposition to the ink layer on one of said ink film ribbons which is fed to a predetermined recording position by said platen; a thermal head including an array of heating elements disposed along an axial direction of said platen, said heating elements being pressed against said platen through said one ink film ribbon and said recording paper; means operatively disposed in said case for feeding said recording paper; means operatively disposed in said case for feeding said one ink film ribbon; means rotatably mounted in said case between said side plates for supporting said thermal head, said thermal head being operatively arranged to be brought against said one ink film ribbon heated in accordance with recording information and transferring an ink image onto a surface of said recording paper; said plurality of interchangeable rolls of ink film ribbon being accommodated in said case and each being contained in ink ribbon-containing cassettes; driving means operatively provided in said case for driving said thermal head supporting means and for setting a clearance between said platen and said thermal head by rotation of said thermal head supporting means, said driving means being operable to open the clearance between said platen and said thermal head in response to an interchange of said rolls of ink film ribbon, with the clearance having a width not less than a maximum diameter of one roll of said ink film ribbon, to allow a first roll of said rolls of ink film ribbon to be moved in a direction substantially perpendicular to a longitudinal axis of said platen without translation along said longitudinal axis and parallel to the ink film take-up direction to the predetermined recording position from a storing position and to be retracted from the predetermined recording position to the storing position, and a second roll of said rolls of ink film ribbon to be interchanged with the first roll by being moved from the storing position to the predetermined recording position while said recording paper remains stationary during the interchange to assure a smooth subsequent printing operation;

an electric controller for controlling said driving means and for effecting the interchange of said rolls of ink film ribbon; and means provided in said case for guiding and positioning said ink film ribbon in relation to the predetermined recording position.

2. A thermal transfer printer according to claim 1, wherein a sensor is provided for identifying different types of said ink film ribbons.

3. A thermal transfer printer according to claim 1, wherein the plurality of interchangeable rolls of ink film ribbon are respectively contained in a plurality of single ink ribbon containing cassettes.

4. A thermal transfer printer according to claim 1, wherein a first of said ink ribbon cassettes containing one roll of said rolls of ink film ribbon is moved by a rotation of said driving means as required in accordance with recording information to the predetermined recording position in which said thermal head is disposed and said first ink ribbon cassette is changed after a completion of a printing operation by said one roll of ink film ribbon to a second of said ink ribbon cassettes containing another roll of said rolls of ink film ribbon; and means is provided for rotating said ink ribbon cassettes so as to automatically send out said first ink ribbon cassette to the predetermined recording position and to receive said second ink ribbon cassette to the storing means in operative cooperation with said guiding means.

5. A thermal transfer printer according to claim 4, wherein said guiding means in said case is operatively associated with said first ink ribbon cassette and said second ink ribbon cassette and comprises a pair of cassette plate members joined to a take-up end portion of said first ink ribbon cassette and said second ink ribbon cassette; and wherein said cassette plate members are turned in accordance with a printing instruction from a control unit to move one of said first ink ribbon cassette or said second ink ribbon cassette alternately onto said platen means and print on said recording paper.

6. A thermal transfer printer according to claim 5, wherein a roller includes a shaft, a joint gear is provided for enabling transmission of a take-up driving force from said platen of said roll of ink film ribbon contained in said first ink ribbon cassette and in said second ink ribbon cassette, and wherein said joining gear is mounted on the shaft of said roller.

7. A thermal transfer printer according to claim 6, wherein the shaft of said roller is provided at one end portion thereof with a roller gear for transmitting a rotation of said platen to said joint gear which is adapted to transmit a rotation of said roller gear to said ink ribbon cassette; a joint gear plate supports said joint gear; and a spring is provided to retract said joint gear plate when said thermal head is removed from said platen to interrupt a transmission of the take-up force of said roll of ink film ribbon to be interchanged.

8. A thermal transfer printer according to claim 5, wherein said first ink ribbon cassette and said second ink ribbon cassette each have a case and are operatively connected to said cassette plate members outside of each case; each of said cassette plate members is fixedly mounted at a central portion thereof on a drum shaft and rotated in response to a rotation of a cassette drum gear adapted to receive a rotational driving force of said ink ribbon feeding means.

9. A thermal transfer printer according to claim 8, wherein the case of the ink ribbon cassette is provided at respective sides thereof with roller guide means for carrying out a rotation of said first ink ribbon cassette and said second ink ribbon cassette around said drum shaft; and a rotatable cassette relief member for guiding said first ink ribbon cassette and said second ink ribbon cassette onto said platen.

10. A thermal transfer printer according to claim 9, wherein said side plates form cassette guides; and the case of the ink ribbon cassette includes a cassette relief supporting member for supporting said rotatable cassette relief member.

11. A thermal transfer printer according to claim 1, wherein the plurality of ink ribbon cassettes are longitudinally arranged, a first of said ink ribbon cassette containing a first roll of said rolls of ink film ribbon is moved by rotation of said driving means as required in accordance with recording information to the predetermined recording position in which said thermal head is disposed, and said first ink ribbon cassette is interchanged with a second of said ink ribbon cassettes after a completion of a printing operation with said first rolls of ink film ribbon; an ink ribbon cassette driving motor; and a cassette transfer means is moved by said ink ribbon cassette driving motor for sending out said first ink ribbon cassette and receiving said second ink ribbon cassette.

12. A thermal transfer printer according to claim 11, wherein said guiding means includes said ink ribbon cassette-driving motor means; said first ink ribbon cassette and said second ink ribbon cassette are longitudinally disposed and selectively employed and are engagable with said cassette transfer means; whereby a take-up driving force of said rolls of ink film ribbon in said first ink ribbon cassette and said second ink ribbon cassette is transmitted thereto from said platen by means mounted on a shaft of said roller for enabling transmission of the take-up driving force.

13. A thermal transfer printer according to claim 1, wherein each of said plurality of ink ribbon cassettes is divided into a take-up portion and a supply portion; each of said rolls of ink film ribbon is selectively withdrawn and positioned at the predetermined recording position of the thermal head; a first of said ink ribbon cassettes containing first of said rolls of ink film ribbon is moved by a rotation of said driving means as required in accordance with recording information to the predetermined recording position in which said thermal head is disposed and said first ink ribbon cassette is interchanged with a second of said ink ribbon cassettes after a completion of a printing operation by said first ink ribbon film second ink ribbon cassette containing said second ink film; and an ink ribbon cassette lifting and lowering motor for moving an ink ribbon cassette fixing member so as to enable said ink ribbon cassette with the selected roll of ink ribbon in the predetermined recording position to be interchanged with another ink ribbon cassette having another of the rolls of ink ribbon.

14. A thermal transfer printer according to claim 13, wherein said guiding means comprises said ink ribbon cassette lifting and lowering motor; said first ink ribbon cassette and said second ink ribbon cassette are arranged one above the other around said ribbon cassette fixing member and are selectively vertically moved by said ink ribbon cassette lifting and lowering motor to withdraw said ink film ribbon from one of said first ink ribbon cassette and said second ink ribbon cassette by an ink withdrawing motor in dependence upon a positioning of said thermal head; a take-up driving force of said ink film ribbon contained in said first ink ribbon cassette and said second ink ribbon cassette is transmitted thereto from said platen by a joint gear mounted on a shaft of said roller for enabling transmission of the take-up driving force.

15. A thermal transfer printer according to claim 1, wherein a plurality of said ink film ribbons are respectively contained in a plurality of ink ribbon cassettes; each of said plurality of ink ribbon cassettes is divided into a take-up portion and a send-out portion; said film ink ribbon is withdrawn and positioned at the predetermined recording position of said thermal head; and said guiding means for said ink ribbon cassettes is automatically changed by withdrawing from said first ink film ribbon in a first ink ribbon cassette to said second ink film ribbon in a second ink ribbon cassette.

* * * * *